US005784847A

United States Patent [19]

Wiklund

[11] Patent Number: 5,784,847

[45] Date of Patent: Jul. 28, 1998

[54] SUSPENSION SYSTEM FOR FALSE CEILINGS

[75] Inventor: Per Wiklund, Boden, Sweden

[73] Assignee: AW Nordic System AB, Vuollerim, Sweden

[21] Appl. No.: 793,591

[22] PCT Filed: Sep. 12, 1995

[86] PCT No.: PCT/SE95/01025

§ 371 Date: Mar. 3, 1997

§ 102(e) Date: Mar. 3, 1997

[87] PCT Pub. No.: WO96/09449

PCT Pub. Date: Mar. 28, 1996

[30] Foreign Application Priority Data

Sep. 22, 1994 [SE] Sweden ..... 9403194

[51] Int. Cl.[6] ..... E04B 5/52

[52] U.S. Cl. ..... 52/506.07; 52/506.06; 52/506.08; 52/220.6

[58] Field of Search ..... 52/506.06–506.08, 52/220.6

[56] References Cited

U.S. PATENT DOCUMENTS

| | | | |
|---|---|---|---|
| 3,495,796 | 2/1970 | Fruh . | |
| 3,832,816 | 9/1974 | Jahn | 52/506.08 X |
| 3,842,561 | 10/1974 | Wong | 52/506.07 |
| 4,160,344 | 7/1979 | Brugman | 52/506.07 |
| 4,416,095 | 11/1983 | Truluck | 52/506.07 |

FOREIGN PATENT DOCUMENTS

| | | |
|---|---|---|
| 2283272 | 3/1976 | France . |
| 1121791 | 1/1962 | Germany . |
| 3409992 | 10/1985 | Germany . |
| 90 309 | 9/1957 | Norway . |

*Primary Examiner*—Christopher Kent
*Assistant Examiner*—Yvonne Horton-Richardson
*Attorney, Agent, or Firm*—Larson & Taylor

[57] ABSTRACT

A suspension system for mounting a false ceiling which allows for adjusting the height of the false ceiling to any desired value. The system includes: a system of ceiling rails screwed or otherwise connected to an existing ceiling; a number of suspension pendulums mounted in the ceiling rails, each of which includes: an upper telescopic part for mounting in a ceiling rail, and a lower telescopic part for connecting false ceiling plates to the suspension pendulums. The telescopic parts of each suspension pendulum are slidable in relation to each other and have a substantially C-shaped horizontal cross section, and branches which are at least slightly resilient, and the upper and lower telescopic parts, at the branch edges thereof are formed with cooperating snap locking means for making it possible to interconnect the telescopic parts in any mutual height positions while the branches bow resiliently out, and in respectively, until they have been lockingly snap engaged in each other.

5 Claims, 3 Drawing Sheets

SUSPENSION SYSTEM FOR FALSE CEILINGS

BACKGROUND OF THE INVENTION

The present invention generally relates to a system for suspending so called false ceilings, for which a system of rails are mounted in an existing ceiling, a number of suspension pendulum means having mounting means for false ceiling bars are mounted suitably spaced along said ceiling rails, a system of false ceiling bars are mounted at the bottom edges of the pendulum means, and plates forming a false ceiling are laid, or are otherwise mounted, on said false ceiling bars.

In many arrangements of the above mentioned type for suspending false ceilings the pendulum means comprises two parts which are telescopically slidable in each other for making it possible to adjust the false ceiling plates to a specific height. Such suspension pendulum means are shown for instance in the patents FR-A-2.283.272, in DE-A-3.409.992 and U.S. Pat. No. 3,459,796. The two telescopic parts are formed with cooperating through bores, and the adjustment in the vertical direction of the pendulum means is made in that the lower telescopic part is displaced to a suitable height in relation to the upper telescopic part, whereupon the two parts are secured to each other by means of a screw or a bolt extending through one or more of the cooperating bores.

Such structures are disadvantageous in several respects:

- the adjustment in the vertical direction of the pendulum is restricted to the mutual spacings between the through bores of the telescopic parts. In some cases there is a need for a substantially more accurate vertical adjustment than can be obtained by means of said known apparatus, for instance in case the existing ceiling is so unlevelled that it may be necessary to adjust the lower telescopic part one or more millimeters upwards or downwards with respect to a certain normal position in order to get a false ceiling which is even and levelling;
- it can also be troublesome to interconnect the lower and the upper telescopic parts, since this has to be made in that the lower telescopic part is first adjusted exactly to the intended height, whereupon a screw is introduced through the cooperating bores of the telescopic parts, and a nut is tightened on the screw extending through said bores;
- in certain known structures it is also necessary that the upper telescopic part be screw connected directly to the existing ceiling or to a ceiling rail, which is a troublesome job for which there is often needed three hands, namely one hand holding the pendulum, a second hand introducing a mounting screw and a third hand mounting a nut, and eventually also a washer, onto the free end of the screw;
- in many cases it is necessary that the lower telescopic part be introduced in the upper telescopic part from underneath after said upper telescopic part has been screw connected to the ceiling or the ceiling rail, and this may cause problems in narrow spaces;
- the screw connected pendulums also are generally bound to the places where they were originally connected, and for a changing the mounting place such pendulum it is thereby necessary that the upper telescopic part be unscrewed from the ceiling or the ceiling rail, even if there is only question of a displacement of some few millimeters.

SUMMARY OF THE INVENTION

The basis of the invention therefore has been to solve the problem of providing a suspension system for a false ceiling, comprising a ceiling rail and a telescopically acting suspension pendulum,

- in which each suspension pendulum is formed as two telescopically slidable parts having a horizontal cross section substantially of C-shape, and formed with interconnecting snap locking means so that said parts can be joined from any mutual vertical positions by only being pressed together, whereby said parts expand/contract resiliently into each other until the parts have been snap engaged and are thereby temporarily secured to each other;
- in which the upper telescopic part is formed with a series of horizontal, elongated, through slots, and the lower telescopic part is formed with a vertical series of obliquely extending (inclined) elongated, through slots—or vice versa—and in which the spacings between the two series of slots differ from each other, so that there is always, and in any accurately adjusted height position between the telescopic parts, a cooperating bore composed of a horizontal slot and an inclined slot, which bore can be used for securing the telescopic parts in relation to each other;
- and in which the ceiling rail and the upper telescopic part of the suspension pendulum, and preferably also the lowermost part of the lower telescopic part, is formed so that the suspension pendulum can quickly and easily be secured to the ceiling rail, and to the false ceiling bar, respectively, in that the pendulum is simply moved straight up, and down respectively, in the rail/bar, and in which the suspension pendulum can be laterally displaced in the rail and can also be released from the rail without the use of a tool.

The above mentioned system makes it possible to quickly and simply mount a false ceiling, and to very accurately adjust each single part of the false ceiling to an exactly determined height position, and it also makes it possible to quickly and simply move the suspension pendulums from one place to any desired offset position, and to as quickly and simply release the suspension pendulums from the existing ceiling.

Now the invention is to be described more closely in connection to an embodiment thereof which is shown in the accompanying drawings. It is to be understood that the illustrated and described apparatus only represents one, out or many, possible examples of the invention, and that many various modifications may be presented win the scope of the appended claims.

DESCRIPTION OF THE PREFERRED EMBODIMENT

Figure 1:
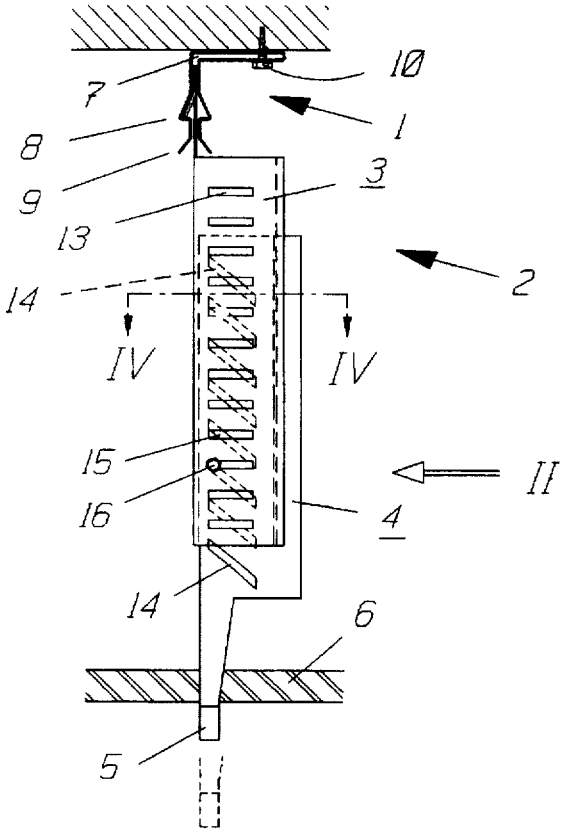
FIG. 1 is a side view transversally of the longitudinal direction of a ceiling rail in a system according to the invention having a false ceiling suspended therein.
Figure 2:
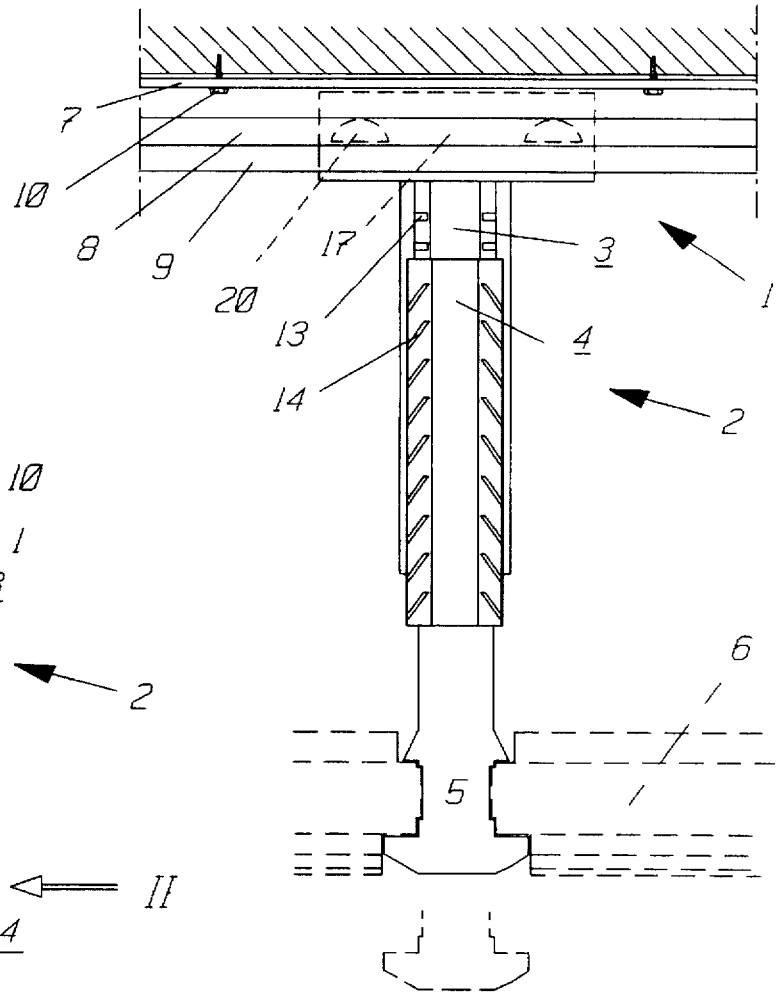
FIG. 2 correspondingly shows a view following the arrow II of FIG. 1 of the same system.

The illustrated system generally comprises a ceiling rail 1, a suspension pendulum 2 which can be mounted in said ceiling rail and having an upper telescopic part 3 and a lower telescopic part 4 and a quick connection means including a downwardly extending mounting part 5 for a false ceiling bar carrying false ceiling plates 6, which connection means is provided in the lower telescopic part 4.

Figure 3:
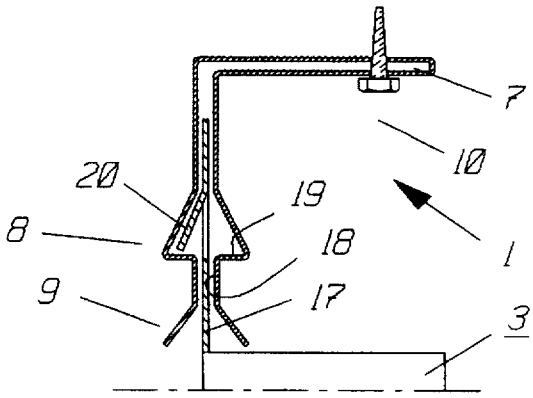
FIG. 3 is an enlarged view of a detail of the ceiling rail of FIG. 1 having a suspension pendulum in which the upper telescopic part is introduced.

As most clearly shown in FIG. 3 the ceiling rail 1 is double folded and is substantially angularly shaped. The double folded upper flange 7 acts as a support surface against an existing ceiling. The web of the vertical ceiling rail part is formed with a widened dovetail portion 8 which acts as a locking means for the upper telescopic part 3 of the suspension pendulum, and the lower edge of said vertical ceiling rail part is conically widened to a guide means 9 both for facilitating the introduction of the suspension pendulum 3 in the ceiling bar 1 and also for enabling a resilient opening of the branches of the actual ceiling rail part thereby releasing a suspension pendulum which in mounted therein. As conventional the ceiling rail 1 is mounted against the existing ceiling by means of screws 10. It is evident that the upper pendulum part 3 can be introduced in the ceiling rail with the sideways extending flanges thereof facing to the right, as shown in the drawings, or facing to the left. It is also evident that the pendulum is locked in the vertical direction in the ceiling rail in that a certain part of the pendulum lockingly engages in the dovetail portion 8, and that the pendulum can be freely displaced laterally, that is in the longitudinal direction of the ceiling rail.

Both the upper telescopic part 3 and the lower telescopic part 4 of the suspension pendulum has a slightly diverging C-shape in a horizontal cross section. The flanges of the upper telescopic part 3 fold in towards each other to form a pair of barb like locking hooks 11. The lower telescopic part 4, which has a smaller horizontal cross section than that of the upper telescopic part 3 for making it possible to introduce the lower part 4 in the upper part 3, has a correspondingly fold in angular catch means 12 which is designed for being locked against the locking hooks 11 when the two telescopic parts are being interconnected. Said two telescopic parts are made of some resilient material, for instance of steel plate or of any suitable plastic material, so that said two parts can be simply moved together whereby the flanges thereof bow resiliently out and in respectively.

Figure 4:
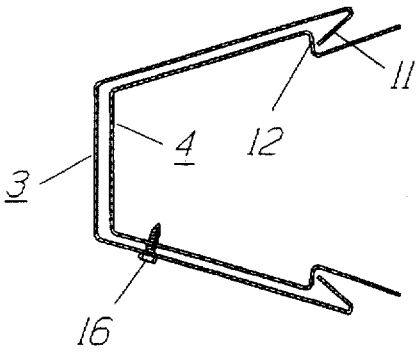
FIG. 4 is a cross section along line IV—IV of the upper and the lower telescopic parts of a suspension pendulum with said parts snap connected to each other.
Figure 7:
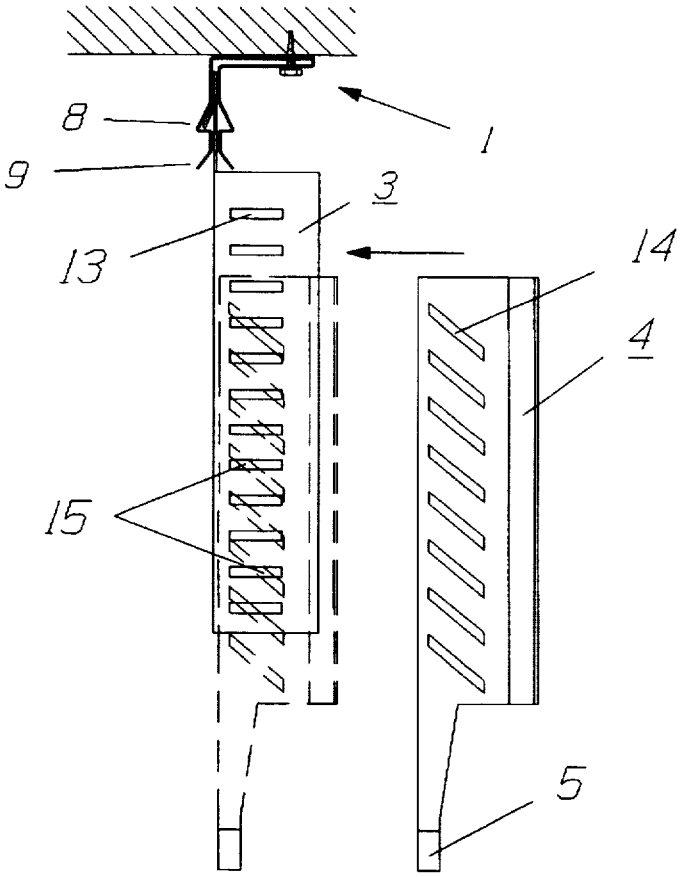
FIG. 7 illustrates how the lower telescopic part is introduced into the upper telescopic part.
Figure 8:
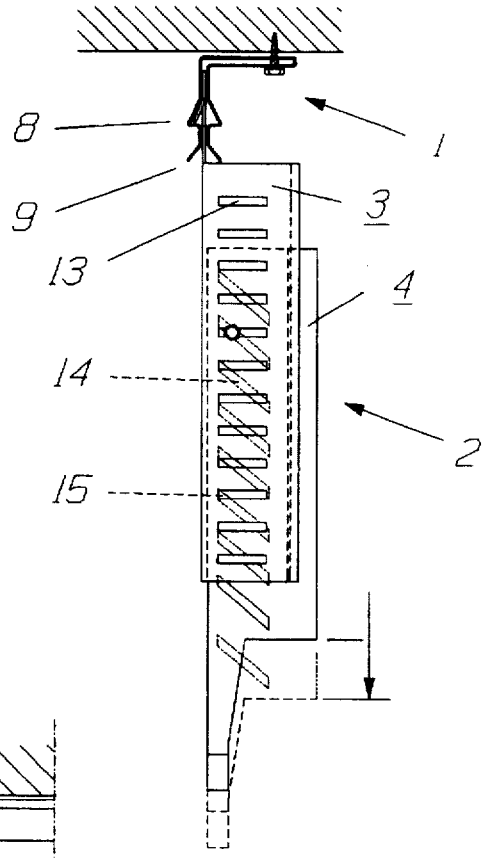
FIG. 8 shows how the height of the suspension pendulum is adjusted and how the two telescopic parts are secured to each other.

The upper, that is the outer, pendulum part 3 is, along one of its flanges, preferably along both flanges, formed with a vertical series of horizontal, elongated slots 13 arranged with even spacings. Correspondingly the lower (inner) pendulum part 4 is formed with a vertical series of inclined, elongated slots 14 arranged with even spacings. Said inclined slots 14 can be provided at an angle to the horizontal plane of 30°–45°. The spacings between the slots 13 differ from the spacings between the slots 14. As shown in FIGS. 1 and 7 the slots 14 of the lower telescopic part 4 have a greater spacing than the slots 13 of the upper telescopic part 3. The purpose thereof is that there should always exist, in any mutual height positions of the telescopic parts 3, 4, a common through opening 15 with a restricted area between two cooperating slots 13 and 14, preferably an opening 15 adjacent the inner edges of the slots through which a locking pin or any other locking means can be introduced thereby locking the telescopic parts exactly and permanently in their mutual height positions. FIGS. 1, 4 and 8 show the telescopic parts 3 and 4 after having been joined permanently by means of a through screw 16.

The web portion, or the rear side, of the outer (upper) telescopic part 3 is formed with an upwardly extending mounting part 17 the length and material thickness of which is adapted to the slot 18 which is formed internally between the downwards extending flanges 8, 9 of the ceiling bar 1. At a place corresponding to the bottom edge 19 of the dovetail widened mounting part 8 of the ceiling rail—when the telescopic part 3 is fully introduced in the ceiling rail—the mounting part 17 of the upper telescopic part 3 is formed with a pair of fold out tongues 20 arranged for being housed in the dovetail widened locking part 8 and to engage the bottom edge 19 of said widened part 8 with the bottom edges of said tongues 20, whereas the bottom edges of the guide part 9 of the rail 1 are in engage, or are located close to the upper edge of the upper telescopic part 3. The mounting part 17 of the upper telescopic part 3 preferably is wider than the web portion of the telescopic part 3 so that said mounting part 17 stabilises the suspension pendulum 2 in the longitudinal direction of the ceiling rail 1.

The lowermost portion of the lower telescopic part 4 is formed with a similar, but downwardly extending mounting part 5 adapted to engage, similarly to the mounting part 17, a lower support bar 21 (see FIG. 9) by means of a simple snap locking means for mounting of false ceiling plates 22.

Figure 6:
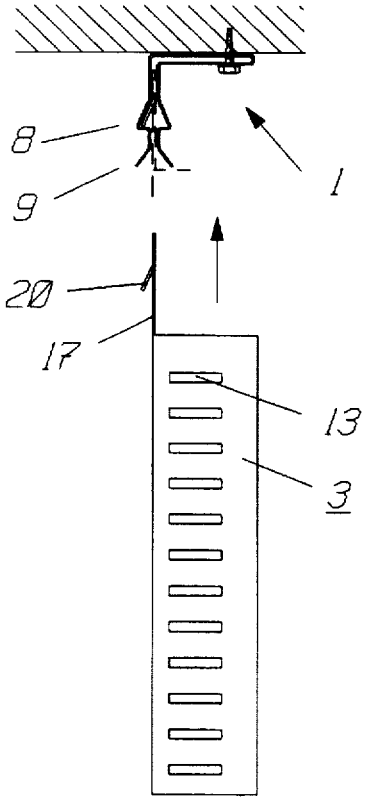
FIG. 6 shows a first stage of the mounting of a false ceiling, whereby a ceiling rail is mounted in an existing ceiling and the upper telescopic part is introduced in said ceiling rail.

The mounting of the above described suspension means is made as follows and as illustrated in FIGS. 5–9:

FIG. 6: The ceiling rail 1 is screw connected to an existing ceiling by means of screws 10. The upper telescopic part 3 is, with the mounting part 17 thereof, pressed up and into the slot 18 formed between the downwardly extending flanges 8, 9 of the ceiling bar 1. When the tongues 20 of the mounting part 17 is passing the guide flanges 9 the slot 18 is pressed open resiliently thereby allowing the tongues 20 to pass, whereupon the flanges 9 snap back to lock the telescopic part 3 against releasing from a the ceiling rail. The telescopic part 3 is locked in the transversal direction by the downwardly extending flanges 8, 9 of the ceiling rail and in the vertical direction by the tongues 20 engaging the bottom 19 of the widened portion 8 and/or by the lower edges of the guide portion 9 engaging the top of the telescopic part 4. On the contrary the telescopic part 3 is rather loosely connected to the ceiling rail 1 in the longitudinal direction thereof and can be displaced in the longitudinal direction of the ceiling rail so as to take an exactly desired position thereon.

Figure 5:
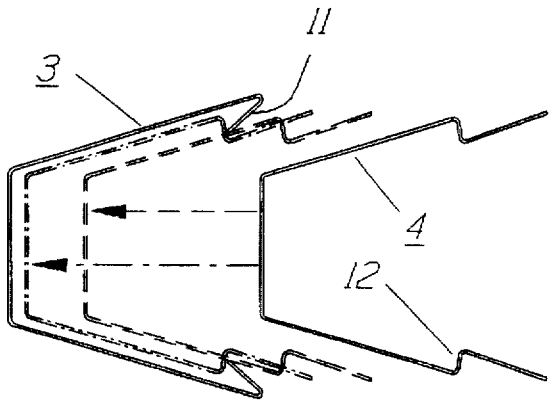
FIG. 5 diagrammatically illustrates the method of interconnecting the telescopic parts of the suspension pendulum.

FIG. 7: The lower telescopic part 4 is sideways pressed directly into the open side of the upper telescopic part 3, as illustrated most clearly in FIG. 5. In FIG. 5 is shown with dotted lines how the telescopic part 4 just starts sliding against the locking hooks 11 of the upper telescopic part 3, and with point-dotted lines is shown that the telescopic part 4 is interconnected to the telescopic part 3, whereby the locking hooks 11 and the angular catch means 12 are lockingly interconnected. Already in this state the lower telescopic part 4 is relatively steadily connected to the upper telescopic part 3, namely by a resilient action and by friction, and it keeps its position without the need of holding same manually.

FIG. 8: In this figure is illustrated how the lower telescopic part 4 can be moved down (or up) to take an exactly desired position in the upper telescopic part 3. In any specific position at least one of the horizontal slots 13 co-operates with at least one of the inclined slots 14 to form at least one common opening 15 having a restricted area, in particular an opening adjacent the edges of one of said slots, and in which opening a locking pin or a similar means can be introduced to lock the telescopic parts 3, 4 in their mutual, adjusted height position. For further, and permanently, securing of the parts 3, 4 a screw 16 can be introduced and tightened in said common opening of the slots 13 and 14.

Figure 9:
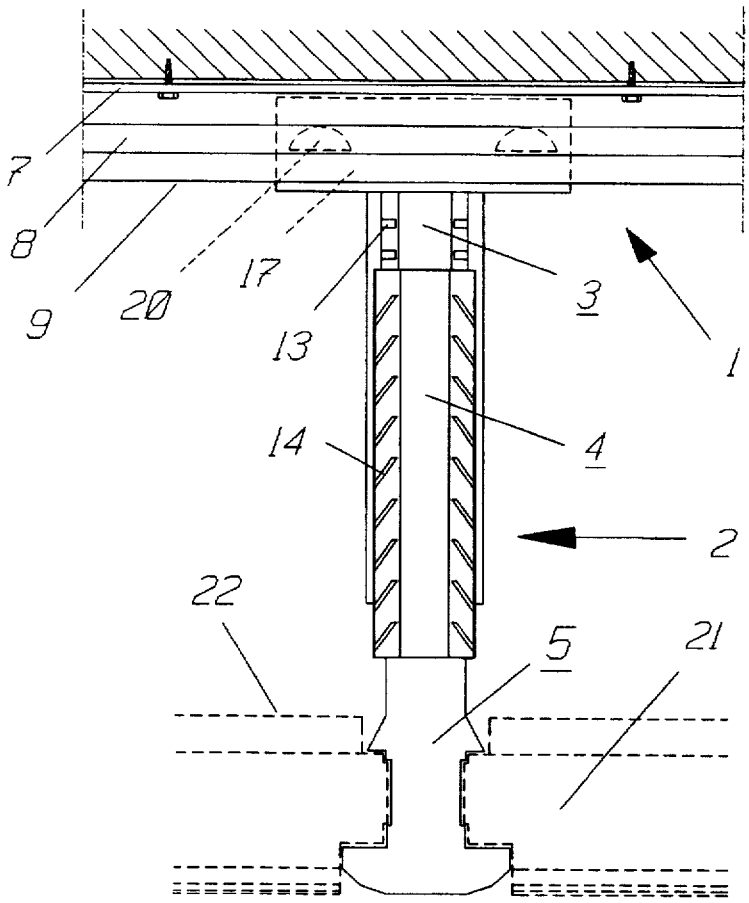
FIG. 9, finally, illustrates how false ceiling bars are mounted in the lower telescopic part of the pendulum and how false ceiling plates are placed on said false ceiling bars.

FIG. 9: At the lower end of the lower telescopic part 4 there are means for mounting of support bars 21. Such mounting can be made like the mounting of the upper telescopic part 3 in the ceiling rail 1. False ceiling plates 22 of any known type can be laid on said support bars 21 in any way known per se.

If it should prove that the false ceiling is slightly uneven, and this may happen if the existing ceiling is slightly uneven or unlevelled, it is possible to easily make a correction by raising or lowering one or more of the suspension pendulums without the need of correcting other parts of the false ceiling system. It is also easy to remove a suspension pendulum without using any tool. This is made in that the downwardly extending branches 8, 9 of the ceiling rail are slightly pressed open so that the tongues 20 of the telescopic part 3 can pulled out of the ceiling bar.

REFERENCE NUMERALS

1 ceiling rail
2 suspension pendulum
3 upper telescopic part
4 lower telescopic part
5 downwardly extending mounting part
6 false ceiling plates
7 upper flange
8 dovetail portion
9 widened flanges, guide means
10 screw
11 locking hook
12 catch means
13 horizontal slots
14 tapering slots
15 opening
16 screw
17 upper mounting part
18 slot
19 lower edge (of 8)
20 tongue
21 support bar
22 false ceiling plate

I claim:

1. A suspension system for mounting of a false ceiling comprising:

a system of ceiling rails adapted to be connected to an existing ceiling, a number of suspension pendulums adapted to be mounted in said ceiling rails (1), each of which comprises:

an upper telescopic part having means for mounting of said part in a ceiling rail, and a lower telescopic part having means for connecting false ceiling plates to said suspension pendulums, said telescopic parts of each suspension pendulum being slidable in relation to each other and having a substantially C-shaped horizontal cross section having branches which are at least slightly resilient so as to enable interconnection of said telescopic parts, and said upper and lower telescopic parts being formed with cooperating snap locking means.

2. The suspension system according to claim 1, wherein one of said upper telescopic part and said lower telescopic part includes a vertical series of horizontal longitudinal, through slots and the other of said upper telescopic part and said lower telescopic part includes a vertical series of inclined longitudinal through slots.

3. The suspension system according to claim 2, characterized in that the spacings between the individual slots of the two series of slots differ, so that in each height position of the telescopic parts there is a communicating through opening, having a restricted area, in common for a horizontal and an inclined slot, wherein said opening is adapted to secure the telescopic parts in relation to each other by introducing a pin or a similar means through said opening.

4. The suspension system according to claim 3, wherein each of said ceiling rails include slots extending vertically downward from said existing ceiling and which are widened to a dovetail shaped locking means; and wherein said upper telescopic parts include at least one fold out tongue for engaging said dovetail shaped locking means and for securing said suspension pendulums in place.

5. The suspension system according to claim 4, wherein said slots are resilient so as to enable an introduction, against spring action, of said at least one fold out tongue of said upper telescopic part and so as to enable releasing of said upper telescopic part by pressing apart said resilient slot.

* * * * *